United States Patent [19]

Castle et al.

[11] 4,064,985

[45] Dec. 27, 1977

[54] SELECTABLE DUAL RATCHET FEED FOR A PRINTER PLATEN

[75] Inventors: William Harold Castle, Winchester; William Ray Crowe; James Lester Herriford, both of Lexington, all of Ky.

[73] Assignee: International Business Machines Corporation, Armonk, N.Y.

[21] Appl. No.: 691,943

[22] Filed: June 1, 1976

[51] Int. Cl.[2] ..... B41J 19/32

[52] U.S. Cl. ..... 197/114 R; 74/126; 192/48.91; 197/127 R

[58] Field of Search ..... 74/126, 128, 142; 192/48.91; 197/114 R, 123, 127 R, 133 R

[56] References Cited

U.S. PATENT DOCUMENTS

| | | | |
|---|---|---|---|
| 1,192,629 | 7/1916 | Hawley | 197/114 R |
| 2,019,073 | 10/1935 | Cooper et al. | 192/48.91 X |
| 2,843,245 | 7/1958 | Scozzafava et al. | 197/123 |
| 3,028,944 | 4/1962 | Taperell | 197/133 R |
| 3,280,957 | 10/1966 | Thiel | 197/114 R |
| 3,326,348 | 6/1967 | Cralle et al. | 197/114 R |
| 3,643,776 | 2/1972 | Tanaka | 197/114 R |

*Primary Examiner*—Paul T. Sewell

*Attorney, Agent, or Firm*—Laurence R. Letson

[57] ABSTRACT

A line feed ratchet arrangement is disclosed which allows selectability between two different line feeds such as the 5 ⅓ lines per inch and six lines per inch and utilizes a drive pawl arrangement having two pawls driven identically. The drive ratchets are selectively engaged by coaxial shifting of a drive member in response to operator movement of a selector knob or similar control.

2 Claims, 2 Drawing Figures

SELECTABLE DUAL RATCHET FEED FOR A PRINTER PLATEN

BACKGROUND OF THE INVENTION

It is many times desirable to be able to shift conveniently between alternate line feed rates when typing. With means of some types, it appears much neater on the page when a 5⅓ lines per inch line feed rate is utilized while other types appear to be more ascetically related when a six lines per inch feed rate is used.

Heretofore intricate systems involving gear trains and idler gears parallel shafts, and mechanisms to engage and disengage the platen from drive feed ratchets have been used. Many of these devices are cumbersome, complex and expensive to manufacture as well as being potential sources of mechanical malfunction.

Other devices require multiple feed pawls, each individually driven in accordance with the selected feed rate and still other prior art patents illustrate varying drive ratios controlled through planetary gear change.

OBJECTS OF THE INVENTION

An object of this invention is to simplify and make more reliable the feed arrangement for controlling the line feed of a typewriter platen while at the same time providng selectability between two rates of line feed.

The foregoing object of the invention together with solutions to the problems presented by the prior art may be more fully understood by complete understanding of the description of the invention to follow.

SUMMARY OF THE INVENTION

A drive member rigidly attached to a shaft may be shifted between engagement of the ratchets of a line feed mechanism such that it is selectably engaged with only one ratchet at a time thereby allowing positive drive through the engaged ratchet and allowing the unengaged ratchet to free wheel or rotate under the influence of the drive pawl without influencing the platen.

DRAWINGS

DETAILED DESCRIPTION OF THE INVENTION

Figure 1:
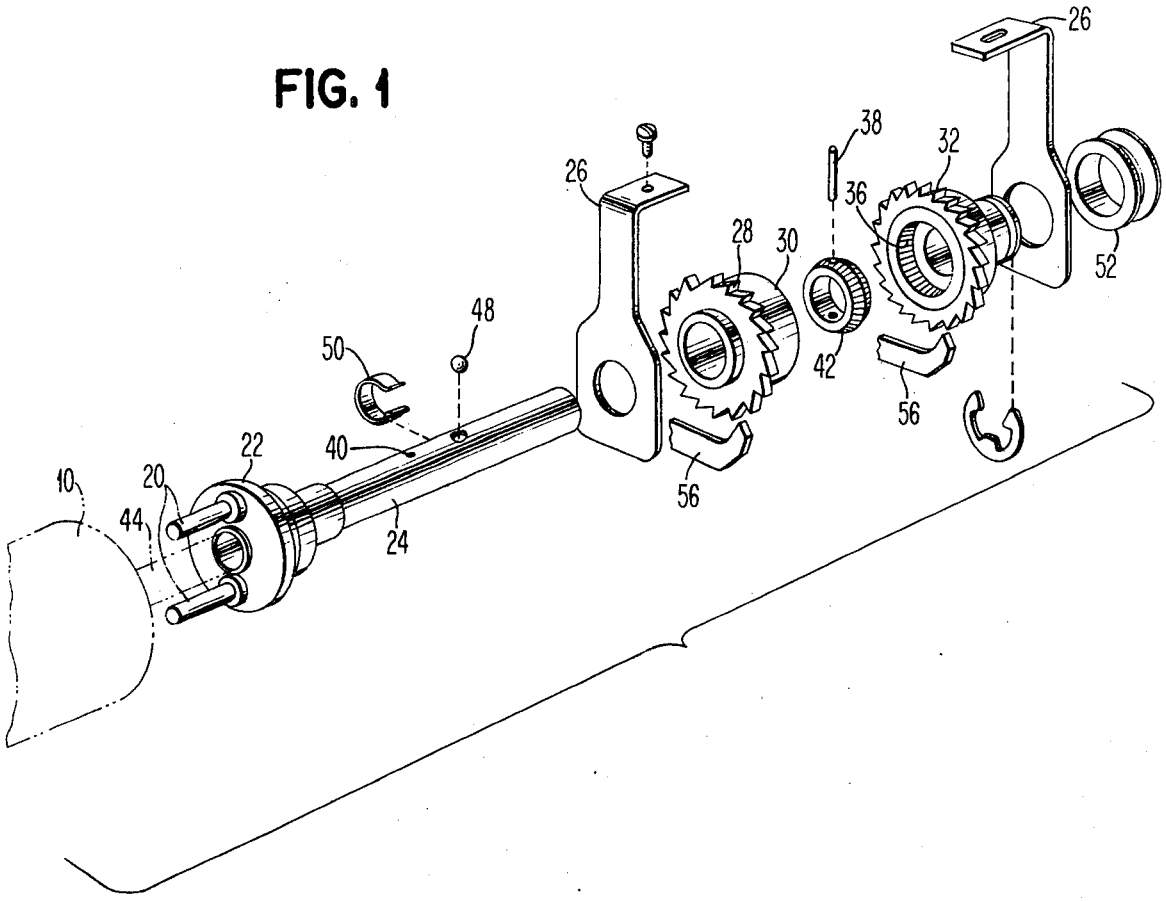
FIG. 1 is an exploded perspective view of the ratchet drive assembly.
Figure 2:
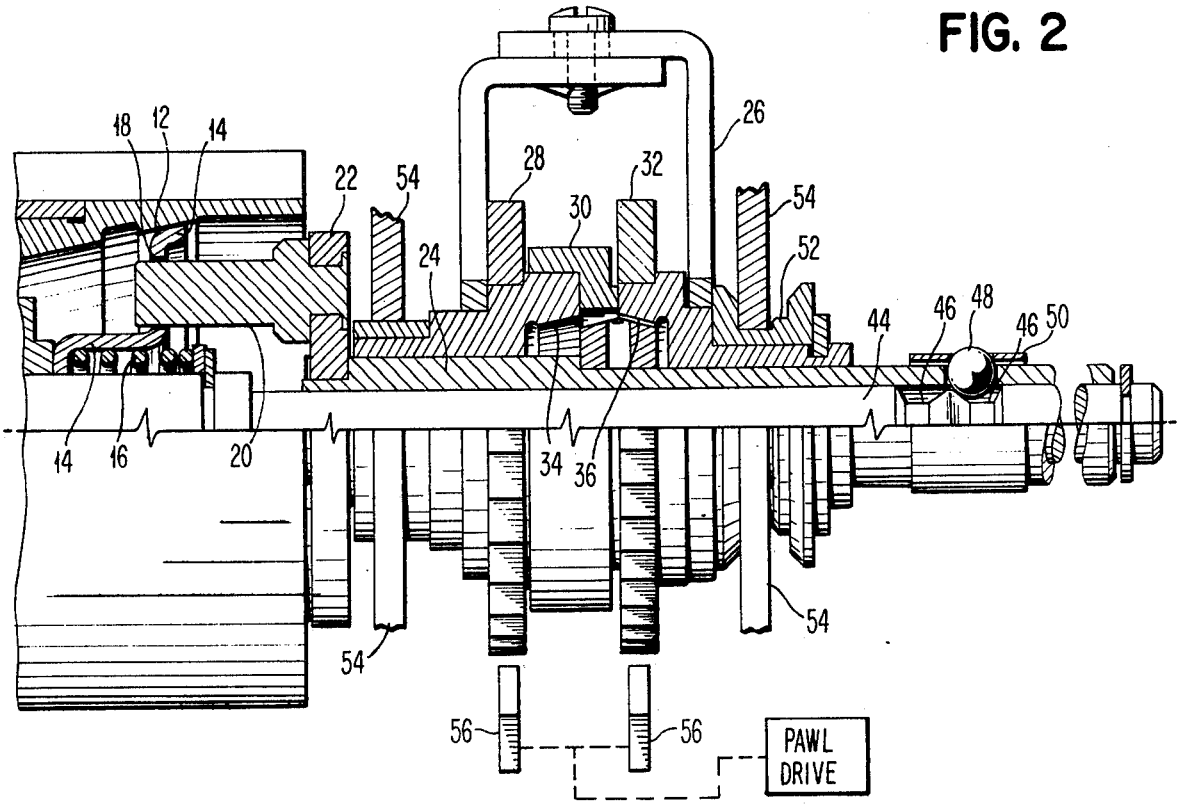
FIG. 2 is a partial sectional view of the ratchet drive assembly.

Referring to FIGS. 1 and 2, a platen 10 is provided with a frustro-conical shaped surface 12 interiorally thereof as is conventional. This frustro-conically shaped surface is engaged by the platen variable 14 which is spring biased by spring 16. In the platen variable 14 are two apertures 18 which engage and receive shafts 20. Shafts 20 are carried by a hub 22. Hub 22 is mounted on an sleeve 24 such that the sleeve and hub move together. Slipped over sleeve 24 is retaining bracket 26 which in FIG. 1 is shown separated. This bracket serves to retain the parts which are contained between its ends and thus restrict lateral movement thereof.

Rotationally positioned on sleeve 24 is a ratchet 28. Ratchet 28 may be formed independently by itself or with a spacer ring shown as 30. Also freely positioned on shaft 24 is a ratchet 32. The teeth configuration of ratchets 28 and 32 may be formed so as to give any desired line feed increments. However the most common increments are 5⅓ lines per inch and six lines per inch. On the interiors of the ratchet wheels 28 and 32 are formed frustro-conical recesses which have ridges or serations running in planes which have the axis of shaft 24 lying thereon. These recesses can be seen at 34 and 36 of FIG. 2 and 36 of FIG. 1.

Rigidly keyed by way of key 38 or other suitable attaching means to sleeve 24 through hole 40 is drive member 42. Drive member 42 is double frustroconical member shaped to mate with recessed frustro-conical surfaces 34 and 36. The serations on drive cone 42 are such that they will positively engage the serated surfaces of complimentary shape in the recesses 34 and 36. Sleeve 34 is hollow so that it may flip over platen shaft 44. Platen shaft 44 is configured with detent grooves 46 to engage detent ball 48 against the force of detent spring 50. Bracket 26 may be anchored to the typewriter or used for any other convenient purpose.

Support collar 52 is slidable over an extended portion of ratchet 32 or is slidable over sleeve 24 as design choices dictate. Support collar 52 may be engaged by frame 54 to support the platen of the typewriter.

The end of shaft 24 may have a platen knob, not shown, engaged therewith.

During operation, pawls 56 may be driven by conventional line feed pawl drives to engage the ratchet teeth of ratchets 28 and 32. Pawls 56 are driven in synchronism and both engage their respective ratchets on each operation. The selection of the amount of line feed accomplished upon each cycle of the operation of pawls 56 is determined by which of the ratchets 28 or 32 are internally engaged by drive member 42 and the number of teeth skipped on each pawl operation. Drive member 42 is shifted from engagement with one of the two ratchets 28, 32 by shifting coaxially of sleeve 24. As the sleeve shifts coaxially, pins 20 slide within the platen variable 14 thus providing relief to the coaxial movement of sleeve 24. The sleeve may be shifted axially by use of the platen knob, not shown or any other conventional control apparatus. As the sleeve is shifted leftward in FIG. 2, detent ball 48 spring relieved against spring 50 will override into the opposite detenting notch and hold sleeve 24 in its displace position. By holding it in its displaced position, then drive member 42 engages the interior drive surface 34 of ratchet 28 coupling ratchet 28 to sleeve 24 and through hub 22 to pins 20.

By selectively coupling the ratchets having differing pitch teeth, the rotation of the platen may be varied. The ratchets may be detented if desired in a conventional manner.

While the invention has been particularly shown and described with reference to a preferred embodiment thereof, it will be understood by those skilled in the art that various changes in form and details may be made therein without departing from the spirit and scope of the invention.

We claim:

1. A line feed control for a printer platen comprising:
   - a rotatable and axially moveable sleeve;
   - a pair of dissimilar pitch ratchet wheels freely rotatably mounted on said sleeve, said sleeve shiftable axially with respect to said ratchet wheels;
   - means to separate said ratchet wheels by a fixed distance;
   - engaging means fixedly attached to said sleeve and shiftable therewith for selectively drivingly engaging said sleeve to one of said ratchet wheels.

2. A selectable line feed mechanism for a printer platen comprising:

a pair of ratchet wheels of differing pitch each mounted for rotation independent of the other;

a pair of pawl means to drive said ratchet wheels simultaneously;

means to selectively drivingly connect one of said ratchet wheels with said platen, said connection means comprising a frustroconical drive surface selectably engageable with a mating surface of one of said ratchet wheels and a force transmission means driveable by said connection means and drivingly connected with said platen.

* * * * *